United States Patent [19]

Megy

[11] 4,072,506

[45] Feb. 7, 1978

[54] METHOD OF SEPARATING HAFNIUM FROM ZIRCONIUM

[75] Inventor: Joseph Allen Megy, Corvallis, Oreg.

[73] Assignee: Teledyne Industries, Inc., Los Angeles, Calif.

[21] Appl. No.: 623,325

[22] Filed: Oct. 17, 1975

[51] Int. Cl.[2] ..... C22B 34/14

[52] U.S. Cl. ..... 75/63; 75/84; 75/84.4

[58] Field of Search ..... 75/63, 84

[56] References Cited

U.S. PATENT DOCUMENTS

| | | | |
|---|---|---|---|
| 2,793,107 | 5/1957 | Jazwinski | 75/84 |
| 3,667,934 | 6/1972 | Derham | 75/63 |

*Primary Examiner*—Peter D. Rosenberg
*Attorney, Agent, or Firm*—Ronald W. Reagin

[57] ABSTRACT

A method for separating hafnium and zirconium is disclosed in which unseparated zirconium and hafnium are dissolved in the molten state in a solvent metal, preferably zinc. This molten metal phase is contacted with a fused salt phase which includes a zirconium salt as one of its components. The desired separation is effected by mutual displacement, with hafnium being transported from the molten metal phase to the fused salt phase, replacing zirconium in the salt, while zirconium is transported from the fused salt phase to the molten metal phase. Separation factors of 300 or more per stage are achieved.

17 Claims, 3 Drawing Figures

METHOD OF SEPARATING HAFNIUM FROM ZIRCONIUM

The present invention relates to methods for separating zirconium and hafnium, and more particularly to an anhydrous method of separating zirconium and hafnium which has higher separating factors than the prior art methods and which is more economical than the prior art methods.

As is well known, zirconium and hafnium are two elements which are extremely similar chemically. They almost always occur together in nature, and they usually enter into identical chemical reactions and compounds with other elements. However, despite the similarity in the characteristics of these elements, many of the applications to which they are put require that the one metal have a high degree of purity with regard to the other metal. For example, one of the main applications to which zirconium is put is its use as a cladding of uranium oxide fuel in nuclear reactors. The nuclear properties of zirconium make it almost ideally suited for this application. However, the corresponding properties of hafnium are so opposite to those of zirconium that hafnium is the material from which control rods in nuclear reactors are usually fabricated. Thus, nuclear grade zirconium must be essentially entirely free of hafnium, with the specification for this material usually allowing no more than some few parts per million of hafnium in the zirconium.

Because zirconium and hafnium are almost always found in nature in the same ore, and because these compounds react chemically the same way, the separation of hafnium from zirconium is one of the major problems in extracting zirconium metal from zirconium ore. The prior art has proposed several different methods for separating hafnium from zirconium. However, these prior art methods have been characterized by relatively low separation factors, high cost and, frequently, difficult operating parameters such as high pressure or the necessity to handle hand-to-handle materials.

For example, probably the leading method of separating zirconium and hafnium in the prior art has been to chlorinate the zirconium ore, which is usually $ZrO_2.SiO_2$ containing approximately 2% by weight $HfO_2.SiO_2$ into a corresponding mixture of $ZrCl_4$ and $HfCl_4$. This "crude" $ZrCl_4$ is mixed with water and ammonium thiocyanate and is passed through a liquid-liquid counter current separation column with methyl isobutyl ketone.

In such a system, although the separator column is a dynamic operation, if each portion of the column is considered to be a "stage," a separation factor of about five per stage can be achieved. Thus, if a long enough separator column, or enough separator columns are used, nuclear grade zirconium can be achieved. However, the system involves a significant capital investment and also requires handling a number of corrosive and difficult to handle materials. The zirconium from the separation is in an aqueus solution, and must eventually be converted again to $ZrCl_4$ in a second chlorinator before it can be reduced to metal.

In another separation system used in some parts of the world, the zircon ore is reacted with potassium silicofluoride to form a mixtue of $K_2ZrF_6$ and $K_2HfF_6$. This mixture is then dissolved in water in which the hafnium salt is about twice as soluble as the zirconium salt. This operation is then repeated through a large number of stages until the desired separation of the zirconium salt and the hafnium salt is achieved, after which the zirconium is recovered from the zirconium salt by any suitable means such as by electrowinning.

Other methods have been proposed in the prior art, but as far as is known, they have not met with any significant commercial application for one reason or another. For example, it has been proposed that the vapors of zirconium tetrachloride and hafnium tetrachloride be passed over zirconium metal to form solid zirconium trichloride and unreacted hafnium tetrachloride vapor, with a separation factor of from 8 to 12 in each stage of this operation. Zirconium tetrachloride is recovered by heating and disproportioning the trichloride. However, zirconium trichloride is extremely hygroscopil and difficult to handle, and this method has never been commercially applied, despite a significant effort expanded in its development.

Similarly, it has been proposed that zirconium tetrachloride and hafnium tetrachloride can be fractionally distilled at high pressures and temperatures, but this method similarly has a very low separation factor, typically about 1.7 per stage, and requires handling the materials at conditions approaching the critical point, which is quite difficult. Accordingly, this method has similarly failed to achieve any commercial success.

It is accordingly an object of the present invention to provide an improved method for separating hafnium and zirconium.

It is yet another object of the present invention to provide an improved anhydrous method of separating zirconium and hafnium in which only one ore cracking step such as chlorination or fluorination is required.

It is still another object of the present invention to provide an improved process for separating zirconium and hafnium which has a separation factor greater than 300 per stage.

It is still another object of the present invention to provide an improved process for separating zirconium and hafnium which is both economical and simple to perform.

Briefly stated, and in accordance with the present invention, unseparated zirconium and hafnium are dissolved in a molten solvent metal, preferably zinc. This molten metal phase is contacted with a fused salt phase which includes a zirconium salt as one of its components. The desired separation is effected by mutual displacement, with hafnium being transported from the molten metal phase to the fused salt phase, replacing zirconium in the salt, while zirconium is transported from the fused salt phase to the molten metal phase. Separation factors of 300 or more per stage are achieved.

For a complete understanding of the invention, together with an appreciation of its other objects and advantages, see the following detailed description of the invention and of the attached drawings, in which.

Figure 1:
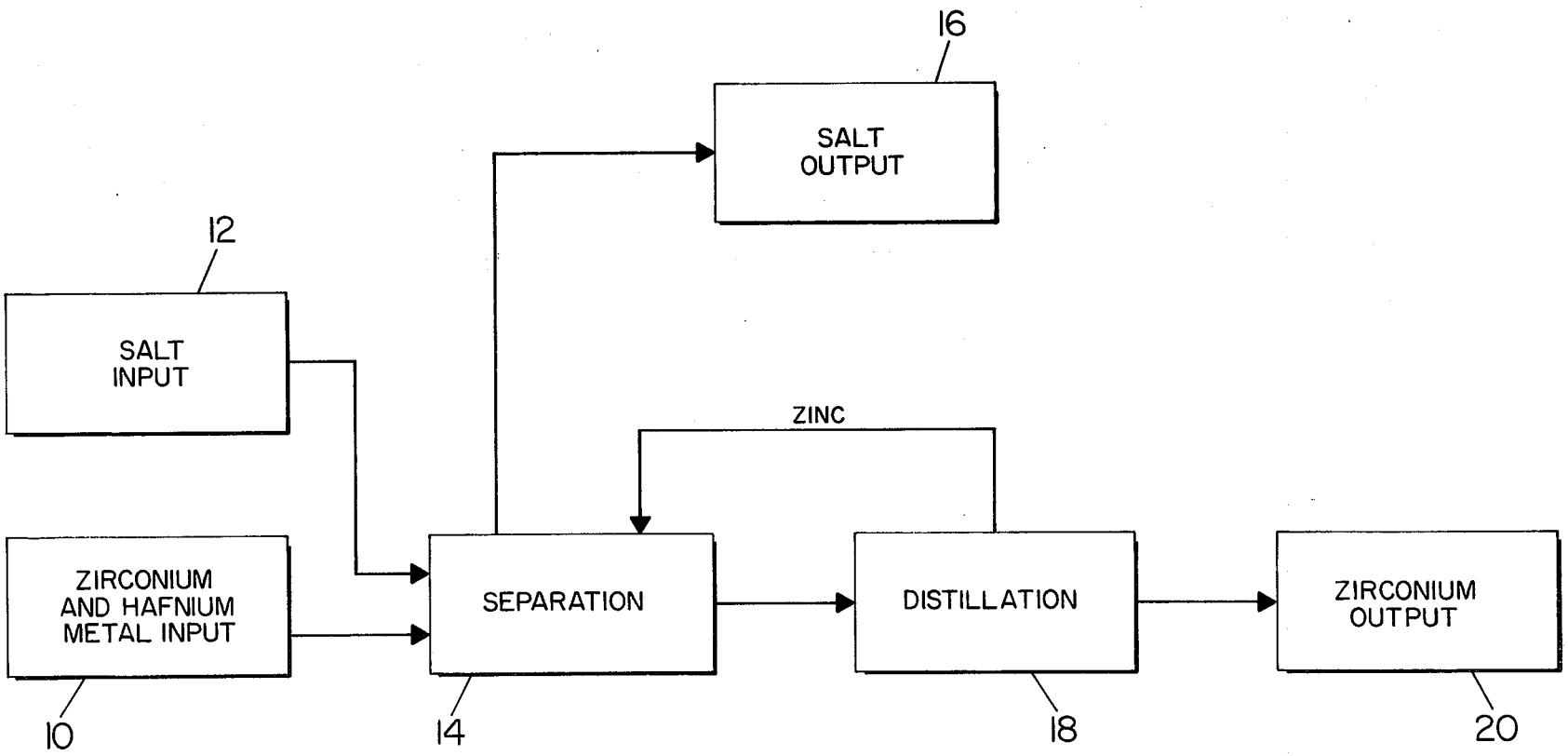
FIG. 1 is a block diagram of one embodiment of the invention, and illustrates the principles of the invention.

The present invention utilizes the fact that hafnium is slightly more electropositive in most systems than zirconium to achieve separation of hafnium and zirconium. Because hafnium is slightly more electropositive than zirconium, the following reaction occurs:

$$Zr^{++++} + Hf \rightarrow Hf^{++++} + Zr \quad (1)$$

It is known that this reaction can be used to achieve separation of hafnium from zirconium. However, the separation factor achieved is not great, and, as is explained in more detail below, the systems of the prior art which have utilized this reaction have not been without their practical problems which have rendered them economically unfeasible.

Utilizing the above reaction, separation of hafnium from zirconium has been achieved in the prior art by contacting the mixture of zirconium and hafnium with a salt which includes zirconium ions in solution which are then displaced by hafnium atoms in the manner described in equation (1) above. For example, the zirconium-hafnium metal can be contacted with a molten salt such as sodium fluorozirconate, causing the following reaction:

$$Na_2ZrF_6 + Hf \rightarrow Na_2HfF_6 + Zr \quad (2)$$

This reaction can achieve a separation factor of about 12, with the separation factor $\beta$ being defined as:

$$\beta = \frac{\frac{Hf_{salt}}{Zr_{salt}}}{\frac{Hf_{metal}}{Zr_{metal}}} \quad (3)$$

However, this is not a practical manner to achieve the separation, for several reasons. First the reaction requires a significant amount time before it approaches anything like equilibrium and acceptable separation factors. This is because the reaction must be between the salt in the liquid phase and the metal in its solid phase, since the salt boils at a temperature far below the melting temperature of the metal, at least at practical pressures. Thus, even if the zirconium-hafnium metal is in a finely divided or powdered state, the reaction still requires long time periods to achieve equilibrium, depending upon the particulate size of the metal.

Other known problems with this reaction include the difficulty of separating the metal from the salt after the reaction is complete. Further, if the reaction is carried out in a chloride salt, halide compounds, such as $ZrCl_3$ and $ZrCl_2$ form. As is well known to those skilled in the art, such lower valence halides are quite difficult to handle. Thus, for these reasons, the abovedescribed separation of hafnium from zirconium by mutual displacement has never achieved practical application.

The present invention achieves separation of zirconium and hafnium by mutual displacement, in accordance with equation (1) above, without the above-described problems by first dissolving the zirconium-hafnium metal in a suitable metal solvent prior to contacting it with the molten or fused salt which contains zirconium ions. The molten metal phase is then stirred vigorously with the fused salt phase to entrain the molten metal phase in the fused salt phase. It has been found that this causes the mixture to approach equilibrium in less than 5 minutes with sufficient agitation, and sometimes in less than 1 minute. Within this time period, reactions such as are described in equation (2) above, are 90% or more complete. The mixture is then allowed to settle, and the fused salt phase rises essentially entirely to the top of the mixture, while the molten metal phase is beneath the fused salt phase. The fused salt phase can then be poured off or siphoned off, or the molten metal phase can be removed through a suitable tap or like in the bottom of the container in which the reaction has then occurred.

It has been found that after such a reaction, most of the hafnium that was in the molten metal phase has been transported to the fused salt phase, with separation factors as high as 300 or more being readilly achieved.

If desired, the molten metal phase may again be subjected to the same process a second time to achieve even lower hafnium concentration, and the entire process may be repeated in as many cycles as desired to achieve the desired purity of zirconium. The solvent metal is then separated from the zirconium in any suitable manner, such as by distillation or sublimation.

The solvent metal is a metal which has the following characteristics. First, of course, it must be a metal in which both zirconium and hafnium are soluble to at least a significant extent. The boiling temperature of the solvent metal must be such that, in the range of operating temperatures of the reaction, both the solvent metal and the fused salt phases are in their liquid phases. The solvent metal should be a metal which is relatively easy to separate from zirconium once the reaction is complete. The solvent metal must be less electropositive than zirconium and hafnium, so that it does not replace zirconium and hafnium in the salt phase. Finally, it is preferable that the metal have the greater affinity for zirconium than it does for hafnium, so that the hafnium atoms in the metal phase are more available for reaction with the zirconium ions in the salt phase to enter into the mutual displacement reaction. In practice it has been found that the best metal for use as a solvent metal is zinc, although other metals, such as cadmium, lead, bismuth, copper, and tin may also be used as the solvent metal.

The characteristics of the salt are as follows: First, the cation in the salt should be more electropositive that zirconium and hafnium so that it will not be reduced by the reductants in the metal phase. Preferred cations are the alkali elements, preferably sodium and potassium, the alkaline earth elements, the rare earth elements and aluminum. The anions in the salt are preferably halides or complexes of halides and the cations given above, so that the salts are halide salts. As is explained in more detail below, the preferred halides are chlorides and fluorides, with the advantages of each being set forth below.

As is set forth below, the zirconium salt which is present in the process is usually $ZrCl_4$ or $ZrF_4$, and by providing chloride or fluoride salts, this allows the formation of $ZrCl_x$ or $ZrF_x$ anions, whose valence is a function of X. The usual such anions formed is $ZrF_7^{---}$ or $ZrF_6^{--}$. These complexed anions reduce the vapor pressure of the zirconium salt to an acceptable level at the temperatures at which separation is effected.

The melting point of the salt must be below the boiling point of the metal used as a solvent for the zirconium, in order that both the salt and the metal may be in the liquid phase at the same time. As is well known to those skilled in the art, the melting temperature of the salt, as well as the viscosity of the salt, can be changed by mixing various salts. Thus, it is frequently useful to add an additional salt such as sodium chloride to the salt phase to reduce the melting temperature of the salt and lower the viscosity of the salt.

As was noted above, it has been found that the best salts to use are either an all-chloride salt system, a chloride-fluoride mixed salt system, or an all-fluoride salt system. The all-chloride salt system has the advantage of being easier to contain. As is well known to those skilled in the art, if a fluoride is present in the fused salt phase, this can lead to difficulties in containment, since the molten fluoride tends to enter into many undesired reactions with either the container material or any other materials present in the system. The disadvantages of the all-chloride salt system is its tendency to form lower valence chlorides such as $ZrCl_2$, the tendency of $ZrCl_4$ to volatize from the salt, and also the tendency of the zinc metal to interact with the zirconium and hafnium salts and enter into the salt phase.

In contrast to this, the chloride-fluoride salt system has a low vapor pressure, very slight interaction of zinc with the salt phase, and a much reduced tendency to form lower valent zirconium compounds in the salt phase. The all-fluoride salt phase has the advantages of the chloride-fluoride salt system and can be used if a zirconium fluoride salt is made from the ore.

The container in which the reaction is carried out must be carefully chosen so that it will contain the materials of the reaction at the temperatures at which the reaction is occurring, while not itself entering into the reaction. A number of different materials have been tried for the container, and it has been found that the preferred containers are formed from graphite.

Having described the general parameters of the present invention, let us now consider a specific example of the use of the process to effect separation of zirconium and hafnium.

FIG. 1 shows a block diagram of a process for separating zirconium and hafnium in accordance with one embodiment of the invention. In FIG. 1, a mixed zirconium and hafnium metal input 10 and a salt input 12 are provided to a suitable container in which the desired separation is to be effected. For example, the zirconium and hafnium mixture is a metal sponge, such as might be obtained as the output of the well-known Kroll process for reducing zirconium from its natural ores. This metal mixture is provided to a separation stage 14, along with a salt component which is a mixture of zirconium tetrachloride (which might also contain a small amount of hafnium tetrachloride therein, since these salts are readily available and are so mixed in the process of reducing zirconium from its ore) and sodium fluoride. Approximately eight moles of sodium fluoride are used for each mole of zirconium tetrachloride. This salt mix, when melted, undergoes the following reaction:

$$ZrCl_4 + 8NaF \rightarrow 4NaCl + Na_3ZrF_7 + NaF \quad (4)$$

Similarly, the hafnium tetrachloride undergoes the following reaction:

$$HfCl_4 + 8NaF \rightarrow 4NaCl + Na_3HfF_7 + NaF \quad (5)$$

A solvent metal, preferably zinc, is also supplied to the separation stage. Typically, a sufficient amount of zinc is provided to provide approximately 12 weight percent zirconium at the conclusion of the operation.

A typical charge into the separation stage 14 is as follows:

TABLE 1

| Input Component | Weight |
|---|---|
| $ZrCl_4$ (2.1 wt.% $HfCl_4$) | 46.83 lb. |
| NaF | 67.36 lb. |
| Zr (2.1 wt.% Hf) | 73.73 lb. |
| Zn | 608.13 lb. |

The mixture is then heated to about 850° C to 900° C and is stirred vigorously to cause the now fused or molten salt phase to entrain the now molten metal phase. At this time, in accordance with the present invention, the hafnium in the metal phase is transported to the salt phase by the following reaction:

$$Na_3ZrF_7 + Hf \rightarrow Na_3HfF_7 + Zr \quad (6)$$

This vigorous mixing is continued for five minutes to one-half hour, and the mixture is then allowed to separate by settling, with the now hafnium enriched molten salt phase rising to the top and the now hafnium depleted molten metal phase settling to the bottom. After separation by any desired manner, the salt phase is taken to the stage 14 to extract the metal from the salt in any desired manner, such as by the reduction process described in FIG. 3 below, and to recover the salt for subsequent use, if so desired. Before any processing, the salt phase now consists of the following components:

TABLE 2

| Component | Weight |
|---|---|
| $Na_3HfF_7$ | 4.05 lb. |
| $Na_3ZrF_7$ | 55.58 lb. |
| NaF | 8.42 lb. |
| NaCl | 46.88 lb. |

The metal phase component is taken to a distillation stage 18, at which the zinc metal is distilled from the zirconium and is again available to be returned to the separation stage 14 for a future separation reaction such as is described above. Prior to such distillation, the metal phase contains the following components:

TABLE 3

| Component | Weight |
|---|---|
| Zn | 608.13 lb. |
| Zr | 72.98 lb. |
| Hf | 0.036 lb. |

The zirconium metal is now available at the zirconium output stage 20, and again consists of sponge metal. As is shown in Tables 1 and 3 above, the zirconium metal has in a single stage been reduced from a hafnium content of approximately 2.1 weight percent to a hafnium content of approximately 500 parts per million.

Figure 2:
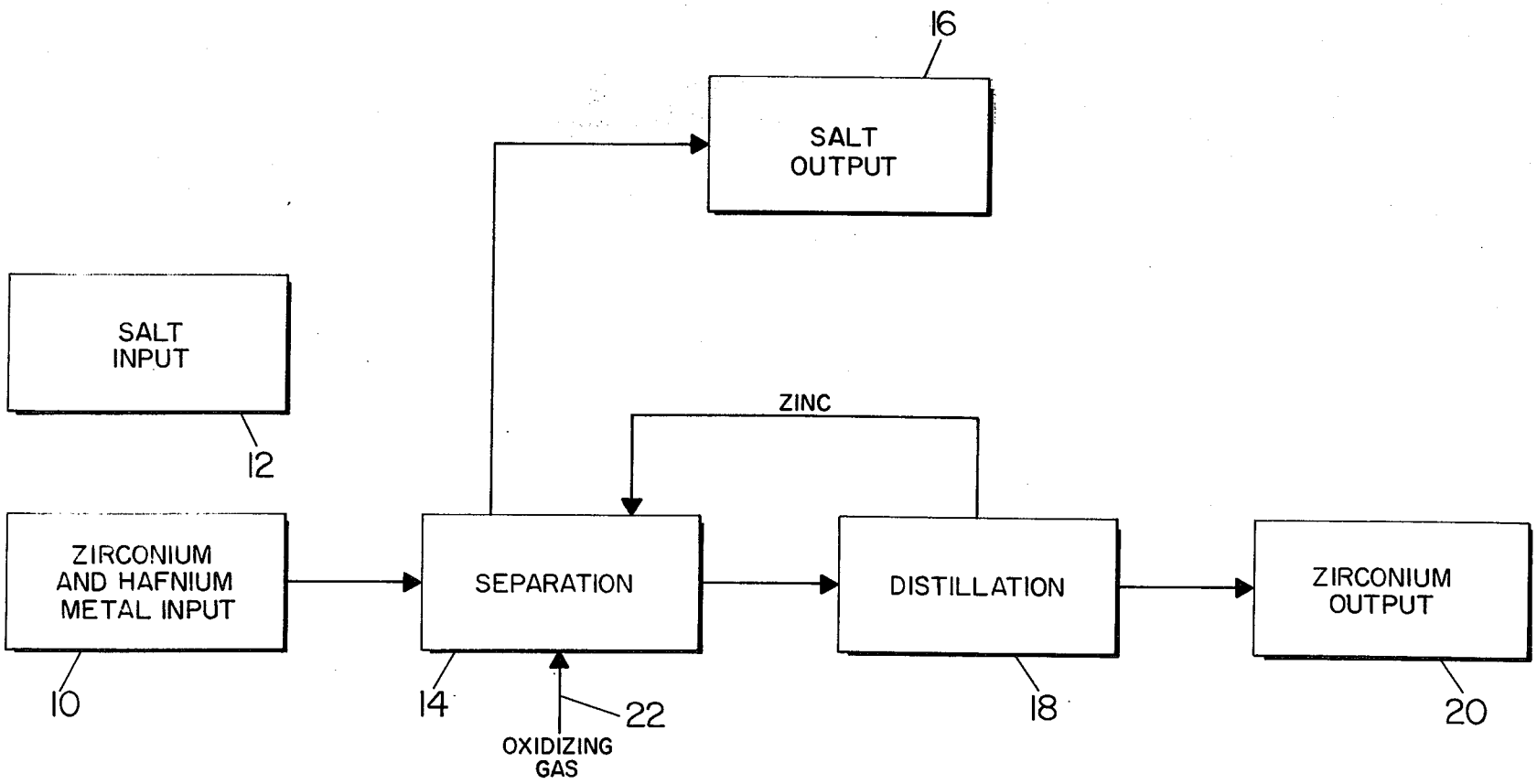
FIG. 2 is a block diagram of a second embodiment of the invention.

FIG. 2 shows a block diagram of a second embodiment of the present invention. The process shown in FIG. 2 is essentially the same as that shown in FIG. 1, except now, at the separation stage 14, after the initial heating and mixing described above is completed, and after the salt phase is removed from the container in which the separation stage 14 is effected, the metal phase is retained in the separation stage 14 and approximately eight pounds of sodium chloride and five pounds of sodium fluoride are added to the container. This salt-metal mixture is then again heated to approximately 850° to 900° C, and an oxidizing gas 22, such as two pounds of $Cl_2$ is passed into the metal, reacting with the zirconium and hafnium in the metal phase to form zirconium and hafnium chloride salts which are absorbed into the salt phase. The two phases are then again well mixed, and the process is completed in the manner described above. It has been found that this two-stage separation process results in a zirconium metal output having a hafnium content of less than 50 parts per million.

In the embodiment of FIG. 2, rather than using chlorine gas as the oxidizing agent, any suitable material can be injected directly into the mixture to form a zirconium salt to provide a second stage of the desired displacement reaction to separate the hafnium from the metal phase into the salt phase. For example, zinc chloride has been successfully used, and in the same instances, it is desirable to inject a zirconium salt such as zirconium tetrachloride directly into the mixture for the second stage of separation.

The following Table 4 shows measured data for a large number of typical processes in which hafnium and zirconium have been separated in accordance with the present invention:

TABLE 4

| METAL INPUT | SALT INPUT | SEPARATION FACTOR |
|---|---|---|
| Zr = 1.460g | $ZrCl_4$ = 4.6582g | |
| Hf = 0.714g | KF = 2.3231g | 214 |
| Zn = 46.00g | NaF = 3.3587g | |
| Zr = 1.788g | $ZrCl_4$ = 3.7272g | |
| Hf = 0.0716g | $HfCl_4$ = 1.2797g | 47.5 |
| Zn = 46.00g | NaF = 3.3537g | |
| | KF = 2.3237g | |
| Zr = 1.0914g | NaCl = 3.17g | |
| Hf = 1.0007g | KCl = 4.04g | 58.9 |
| An = 24.000g | $ZrCl_4$ = 2.79g | |
| Zr = 731 mg | NaCl = 2.6295g | |
| Hf = 355 mg | KCl = 3.3528g | 33.6 |
| Zn = 23.0g | $ZrCl_4$ = 2.3178g | |
| Zr = 1.820g | $ZrCl_4$ = 4.6582g | |
| Hf = 0.0035g | NaF = 3.5870g | 29.5 |
| Zn = 46.00g | KF = 2.3240g | |
| Zr = 2.92g | $ZrCl_4$ = 9.3164g | |
| HF = 1.413g | KF = 4.6462g | 184.9 |
| Zn = 92.0g | NaF = 6.7174g | |
| Zr = 3.58g | $ZrCl_4$ = 9.3164g | |
| HF = .143g | KF = 4.6462g | 98.5 |
| Zn = 92.00g | NaF = 6.7174g | |
| Zr = 5.37g | $ZrCl_4$ = 13.9746g | |
| Hf = .217g | KF = 6.9693g | 120 |
| Zn = 46.00g | NaF = 10.0761g | |
| Zr = 1.46g | $ZrCl_4$ = 4.6582g | |
| Hf = .7065g | KF = 2.3231g | 42.5 |
| Zn = 46.00g | NaF = 3.3587g | |
| Zr = 1.790g | $ZrCl_4$ = 4.6582g | |
| Hf = .0715g | KF = 2.3231g | 100.8 |
| Zn = 46.00g | NaF = 3.3581g | |

Figure 3:
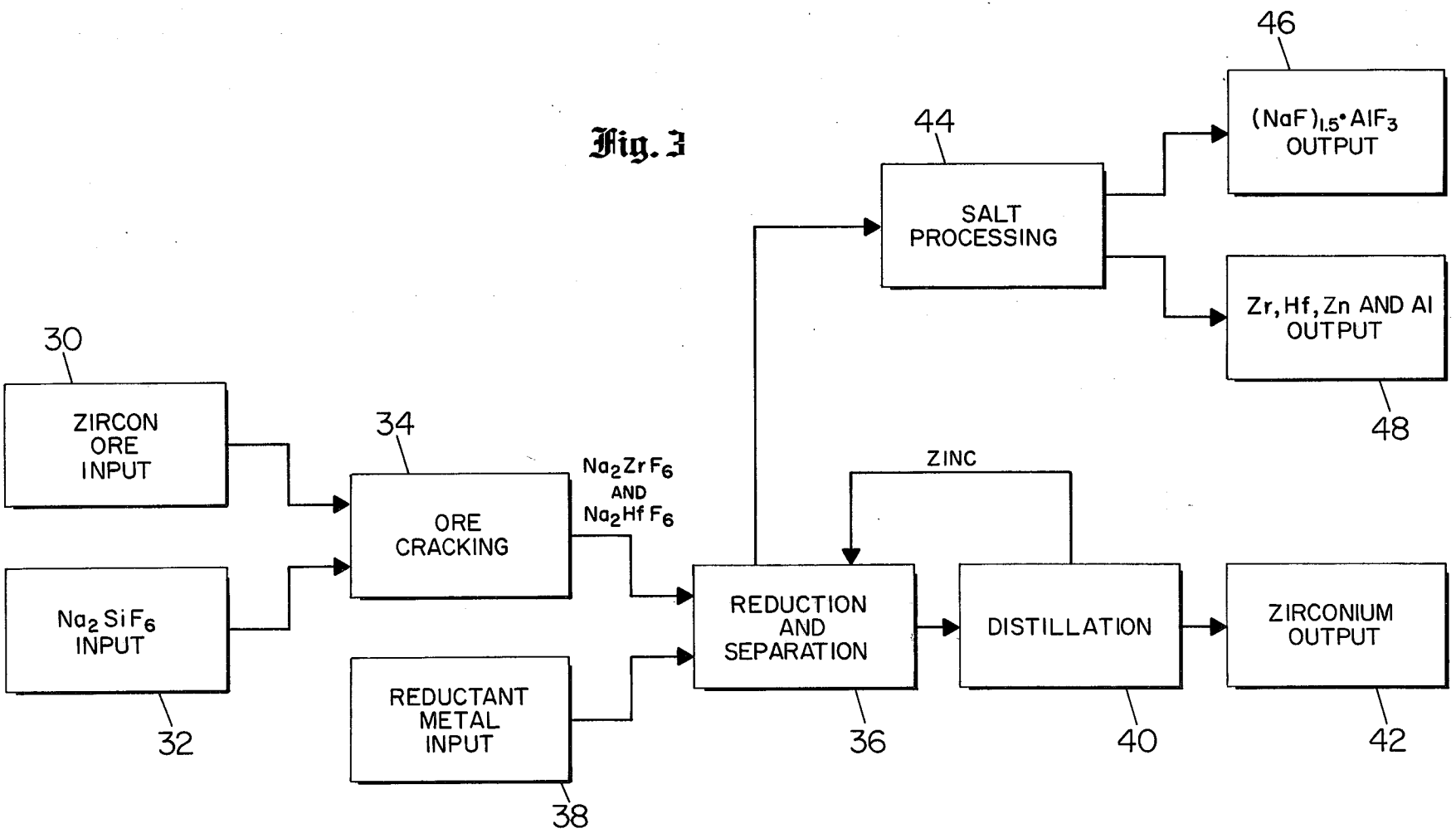
FIG. 3 is a block diagram of a third, and the presently preferred embodiment of the invention.

The foregoing description of the parameters of the present invention and the description of FIGS. 1 and 2 have illustrated the principals upon which the present invention is based. The presently preferred embodiment of the invention is a somewhat more complex process than the relatively simple processes of FIGS. 1 and 2, and comprises a complete process for obtaining zirconium in which the input material is a raw zircon ore and finished, high purity zirconium is obtained as the output product. FIG. 3 is a block diagram of that complete process, and discloses the presently preferred embodiment of the invention.

In FIG. 3, the input materials to be processed are zircon ore, which, as was discussed above, is $ZrO_2.SiO_2$ containing relatively low levels of $HfO_2.SiO_2$, and sodium silicofluoride ($Na_2SiF_6$). These inputs are represented by the blocks 30 and 32 respectively in FIG. 3. These materials are supplied to an ore cracking stage 34, in which the following reactions occur:

$$Na_2SiF_6 + ZrO_2.SiO_2 \rightarrow Na_2ZrF_6 + 2SiO_2 \quad (7)$$

and $$Na_2SiF_6 + HfO_2.SiO_2 \rightarrow Na_2HfF_6 + 2SiO_2. \quad (8)$$

Typically, the ore cracking stage 34 is effected in an indirectly fired kiln at a temperature of approximately 700° C for approximately 1 hour.

The output product is removed from the kiln, and the $Na_2ZrF_6$ and $Na_2HfF_6$ are leached from the $SiO_2$ and crystalized from the leach liquor. This is in itself a good purification step for the zirconium, and removes the zirconium from most of the other impurities which may be present in the ore other than hafnium.

The $Na_2ZrF_6$ and $Na_2HfF_6$ are then supplied to a reduction and separation stage 36, in which they are dissolved in a solvent metal such as zinc, as was described above in connection with FIGS. 1 and 2. However, in accordance with the preferred embodiment of the present invention, a reductant metal input 38 is also supplied to the reduction and separation stage 36. A primary characteristic of the reductant metal is that it is more electropositive than zirconium and hafnium, so that it can replace these elements in the salts, thereby reducing the elements to their metallic stage. Another important characteristic of the reductant metal is that it has less affinity for zinc than zirconium has for zinc, so that no alloy of the reductant metal and zirconium is formed; instead, zinc forms an alloy with zirconium and rejects the reductant metal. Also, of course, it is important that the reductant metal be a liquid at the temperatures at which the reaction is occurring. The presently preferred reductant metal is aluminum, although other possible reductant metals such as magnesium, sodium and calcium can be used.

In the reductant and separation stage 36, the zinc aluminum and $Na_2ZrF_6$ and $Na_2HfF_6$ are heated to a temperature of approximately 900° C, at which the entire mixture is molten, and the molten liquids are stirred vigorously, as in FIGS. 1 and 2 above. At this time, the following reactions occur:

$$3Na_2ZrF_6 + 4Al \xrightarrow{Zn} 4[(NaF)_{1.5} \cdot AlF_3] + 3Zr \quad (9)$$

and $$3Na_2HfF_6 + 4Al \xrightarrow{Zn} 4[(NaF)_{1.5} \cdot AlF_3] + 3Hf \quad (1)$$

In the preferred embodiment of the invention, approximately 85 to 95% enough aluminum to complete the above reactions for 11 of the $Na_2ZrF_6$ is supplied to the reduction and separation stage 36, so that some $Na_2ZrF_6$ is left in the mixture. Now, in accordance with the present invention, any hafnium metal which was formed in accordance with equation (10) above displaces the zirconium ion in the salt by the following reaction:

$$Na_2ZrF_6 + Hf \rightarrow Na_2HfF_6 + Zr \quad (11)$$

After vigorous stirring, the mixture is allowed to settle, and the salt phase is removed from the metal phase, in the manners described above. The now separated metal phase is then again taken to a distillation phase 40, at which the zinc is distilled from the zirconium. The zinc can then be returned for reuse in the reduction and separation stage 36. Virtually pure zirconium is now available at the zirconium output 42.

The following Table 5 shows the input materials, output products and separation factors achieved in five typical runs in accordance with the process just described:

TABLE 5

| INPUT MATERIAL | ZIRCONIUM OUTPUT | SEPARATION FACTOR |
|---|---|---|
| $Na_2ZrF_6$ - 85 lb.<br>$Na_2HfF_6$ - 0.7 lb.<br>Zn - 230 lb.<br>Al - 9.6 lb. | 24.2 lb. | 185 |
| $Na_2ZrF_6$ - 85 lb.<br>$Na_2HfF_6$ - 0.7 lb.<br>Zn 231 lb.<br>Al - 9.6 lb. | 24.3 lb. | 105 |
| $Na_2ZrF_6$ - 85 lb.<br>$Na_2HfF_6$ - 0.7 lb.<br>Zn - 236 lb.<br>Al - 9.8 lb. | 24.9 lb. | 346 |
| $Na_2ZrF_6$ - 85 lb.<br>$Na_2HfF_6$ - 0.7 lb.<br>Zn - 235 lb.<br>Al - 9.8 lb. | 24.7 lb. | 278 |
| $Na_2ZrF_6$ - 85 lb.<br>$Na_2HfF_6$ - 0.7 lb.<br>Zn - 235 lb.<br>Al 9.8 lb. | 24.7 lb. | 361 |

In accordance with another of the features of the present invention, when the salt phase is removed from the reduction and separation stage 36 after completion of the reactions described above, it is taken to a salt processing stage 44. At this time, the salt phase is again a mixture of $(NaF)_{1.5}.AlF_3$, $Na_2ZrF_6$ and $Na_2HfF_6$, but is considerably richer in hafnium than was the input salt to the reduction and separation stage 36. At the salt processing stage 44, these salts are again melted and mixed with a molten zinc bath, and a reductant metal such as aluminum is again provided to the bath. Now, however, in contrast with the reduction and separation stage 36 described above, a sufficient amount of aluminum is provided to complete the reactons of equations (9) and (10) above for the entire salt phase. After this reaction is completed, the now virtually pure molten $(NaF)_{1.5}.AlF_3$ is removed from the molten metal phase, and these materials are provided at the putputs 46 and 48 respectively of FIG. 3.

The salt $(NaF)_{1.5}.AlF_3$, which may be termed a pseudo cryolite, is itself a desirable product which can be sold to the aluminum industry, and thus the only salt by-product of the process f FIG. 3 is itself useful, and not a waste product. Similarly, in the metals output 48, the zinc can again be distilled off and resued in the process, leaving only the hafnium, zirconium, and slight amounts of aluminum as output metals from this part of the process. If desired, these metals may be returned to the reduction and separation stage 36 to further extract any zirconium in this metal. In any event, in a typical such process, the amount of output metal left at the stage 48 is only approximately 5% of the available metals which was in the zircon ore at the input stage 30.

If even higher separation factors of zirconium and hafnium are desired, in the embodiment of FIG. 3, the reduction and separation stage 36 may also be "fluxed" in the manner described in FIG. 2 above. If this is desired, the presently preferred manner to do this is to inject a quantity of $ZnF_2$ into the zinc-zirconium molten metal after the salt phase has been removed from the metal phase. At this time, the following reaction occurs:

$$2ZnF_2 + Zr \rightarrow ZrF_4 + 2Zn. \quad (12)$$

The zirconium tetrafluoride so formed then reacts with any remaining hafnium in the metallic phase in accordance with the following equation:

$$ZrF_4 + Hf \rightarrow HfF_4 + Zr. \quad (13)$$

If this second stage of separation is desired, it is the presently preferred practice to provide enough zinc fluoride to oxidize about 2% of the zirconium in the metal phase. Thus, in the quantities given in the examples of Table 5 above, it is preferred to use about 1.1 lbs of $ZnF_2$ for this fluxing operation, if it is to be effected. If an excess of $ZnF_2$ is provided, it results in a higher hafnium removal, but at the expense of a loss of a greater amount of zirconium. Similarly, if less $ZnF_2$ is used, a lower hafnium removal is achieved, but a greater quantity of zirconium remains in the metallic phase.

It is noted that, in contract to the processes described in FIGS. 1 and 2 above, in the presently preferred embodiment described in FIG. 3, no excess sodium fluoride is provided into the reaction at the separation stage. As was described above, this results in the formation of the pseudo cryolite salt $(NaF)_{1.5}.AlF_3$. If an excess of sodium fluoride were provided in this phase of the reaction, the resultant salt would be ordinary cryolite, or $(NaF)_3.AlF_3$, which does not melt until a temperature over 1000° C, which is above the boiling temperature of the zinc-zirconium metal mixture.

Those skilled in the art will readily appreciate that the embodiment of FIG. 3 further differs from the embodiments of FIGS. 1 and 2 in that no zirconium metal input is required to the reduction and separation stage 36. Instead, the zirconium metal is directly reduced from the salt phase by the reductant metal input, and the zirconium ions remaining in the salt phase react directly with any hafnium metal which is also reduced by the reductant metal to take the hafnium back into the salt phase, thereby effecting the desired high degree of separation in accordance with the present invention.

Those skilled in the art will further recognize that the embodiment of FIG. 3 also reduces hafnium metal from a hafnium compound in the same manner as zirconium is reduced. Thus, the method can be used to reduce hafnium, and is a superior reduction method than the prior art methods of reducing hafnium.

While the invention is thus disclosed and several embodiments are described in detail, it is not intended that the invention be limited to these shown embodiments. Instead, many modifications will occur to those skilled in the art which lie within the spirit and scope of the invention. It is thus intended that the invention be limited in scope only by the appended claims.

What is claimed is:

1. The method of separating hafnium from zirconium, which comprises the steps of:

preparing a molten metal phase which comprises a solution of unseparated zirconium and hafnium and a solvent metal; and contacting the molten metal phase with a fused salt phase which includes a zirconium salt as one of its components, whereby zirconium and hafnium separation is effected by mutual displacement, with hafnium being transported from the molten metal phase to the fused salt phase while zirconium is transported from the fused salt phase to the molten metal phase.

2. The method of claim 1 in which the solvent metal is less electropositive than zirconium.

3. The method of claim 1 in which the solvent metal is selected from the group consisting of zinc, cadmium, lead, bismuth, copper and tin.

4. The method of claim 1 in which the solvent metal is zinc.

5. The method of claim 1 in which the cations of the fused salt phase are more electropositive than zirconium.

6. The method of claim 5 in which at least a portion of the cations in the fused salt phase are selected from the group consisting of the alkali elements, the alkaline earth elements, the rare earth elements and aluminum.

7. The method of claim 5 in which at least a portion of the cations in the fused salt phase are alkali elements.

8. The method of claim 7 in which at least a portion of the cations in the fused salt phase are sodium.

9. The method of claim 7 in which at least a portion of the cations in the fused salt phase are potassium.

10. The method of claim 1 in which at least a portion of the salts in the fused salt phase are halide salts.

11. The method of claim 10 in which at least a portion of the halide salts are fluoride salts.

12. The method of claim 10 in which at least a portion of the halide salts are chloride salts.

13. The method of separating hafnium from zirconium, which comprises the steps of:

preparing a molten metal phase which comprises a solution of unseparated zirconium and hafnium and a solvent metal; and oxidizing a portion of the zirconium in the molten metal phase to form a zirconium salt in the fused salt phase, whereby zirconium and hafnium separation is effected by mutual displacement, with hafnium being transported from the molten metal phase to the fused salt phase while zirconium is transported from the fused salt phase to the molten metal phase.

14. The method of claim 13 in which a portion of the zirconium in the molten metal phase is oxidized by injecting an oxidizing agent into the molten metal phase.

15. The method of claim 14 in which the oxidizing agent is chlorine, whereby the formed zirconium salt is zirconium tetrachloride.

16. The method of claim 13 in which the solvent metal is zinc and a portion of the zirconium is oxidized by injecting a zinc salt into the molten metal phase, whereby zirconium from the molten metal phase displaces the zinc ion in the zinc salt to form a zirconium salt.

17. The method of claim 16 in which the zinc salt is $ZnF_2$, and the zirconium salt formed is $ZrF_4$.

* * * * *